US009644928B2

(12) United States Patent
Krause et al.

(10) Patent No.: US 9,644,928 B2
(45) Date of Patent: May 9, 2017

(54) BULLET AND PRACTICE CARTRIDGE FOR USE ON A SHOOTING RANGE

(71) Applicant: RUAG AMMOTEC GMBH, Fuerth (DE)

(72) Inventors: Bernd Krause, Nuremberg (DE); Claus Reuther, Grossschweidnitz (DE); Martin Liebl, Roth (DE)

(73) Assignee: RUAG AMMOTEC GMBH, Fürth (DE)

( * ) Notice: Subject to any disclaimer, the term of this patent is extended or adjusted under 35 U.S.C. 154(b) by 0 days.

(21) Appl. No.: 14/426,575

(22) PCT Filed: Sep. 5, 2013

(86) PCT No.: PCT/EP2013/068356

§ 371 (c)(1),
(2) Date: Mar. 6, 2015

(87) PCT Pub. No.: WO2014/037434

PCT Pub. Date: Mar. 13, 2014

(65) Prior Publication Data

US 2015/0233687 A1 Aug. 20, 2015

(30) Foreign Application Priority Data

Sep. 6, 2012 (DE) ..... 10 2012 017 630

(51) Int. Cl.
*F42B 12/34* (2006.01)
*F42B 8/02* (2006.01)

(52) U.S. Cl.
CPC ..... *F42B 8/02* (2013.01)

(58) Field of Classification Search
CPC ..... F42B 8/02
USPC ..... 102/444, 501, 439; 86/10
See application file for complete search history.

(56) References Cited

U.S. PATENT DOCUMENTS

| | | | | |
|---|---|---|---|---|
| 1,095,501 A | | 5/1914 | Hoagland | |
| 2,309,561 A | | 1/1943 | Westin et al. | |
| 5,714,707 A | * | 2/1998 | Ruia | F42B 33/06 86/1.1 |

(Continued)

FOREIGN PATENT DOCUMENTS

| | | |
|---|---|---|
| DE | 93 11 349 U1 | 9/1993 |
| DE | 10 2011 005 389 B3 | 3/2012 |

OTHER PUBLICATIONS

International Search Report for PCT/JP2013/068356 dated Nov. 29, 2013.

*Primary Examiner* — Michael David
(74) *Attorney, Agent, or Firm* — Fitch, Even, Tabin & Flannery, LLP

(57) ABSTRACT

Disclosed is a bullet and practice cartridge for use on a shooting range having a cylindrical rear part and an ogive region at the nose end. The ogive region has a rear end and a bullet tip. In order that the bullet behaves like a conventional full metal jacket round nose bullet in a soft target, and moreover has a low energy output in the soft target, that the bullet does not deform or splinter in soft materials, and that the bullet does not puncture protective materials of bullet catchers, the bullet is constructed in one piece, the ogive region is closed all round a cavity and the wall thickness of the ogive region decreases constantly from the rear end to the tip.

7 Claims, 1 Drawing Sheet

(56) References Cited

U.S. PATENT DOCUMENTS 6,374,743 B1 * 4/2002 Hug ..... F42B 12/80
102/514

* cited by examiner

BULLET AND PRACTICE CARTRIDGE FOR USE ON A SHOOTING RANGE

BACKGROUND

Technical Field

The invention relates to a bullet for shooting range and practice cartridges, said bullet having a cylindrical rear part and an ogive region at the nose end, wherein the ogive region comprises a rear end and a bullet tip.

Description of the Art

Bullets, in particular for police operations, are distinguished in that they are either dimensionally stable (military) or deforming (police operations ammunition). For bullets that deform, the cross-sectional area increases when the bullets hit soft targets, and therefore the load per unit area is reduced to values that can be absorbed by a bulletproof vest. Dimensionally stable bullets produce a higher load per unit area because of their ogive shape or ogive region and therefore have better penetration capability. Lead-free (solid) practice bullets usually have good penetration capability, depending on the material, because the material deformability is low. Lead is significantly more ductile in this context.

SUMMARY

The problem to be addressed by the invention is that of designing a bullet that behaves like a traditional full-metal-jacket round-nosed bullet (bullet having a closed form consisting of a cylindrical guiding part and an ogive, largely dimensionally stable) in a soft target. In addition, the bullet should have low energy transfer in a soft target, no deformation, and no splintering. There should be no punching effect in protective materials of bullet traps. Typical police operations bullets punch 4-mm holes in rubber-like materials as intended. This punching effect increases the costs in training operations.

This problem is solved in that the bullet is designed as a single-piece bullet, the ogive region is closed on all sides and has a cavity, and the wall thickness of the ogive region continuously decreases from the rear end to the tip. When the bullet according to the invention hits a target, the ogive region is compressed because of the cavity (see FIG. 3). Thus, the bullet behaves like a traditional full-metal-jacket round-nosed bullet in a soft target. Furthermore, the bullet has low energy transfer in a soft target, does not substantially deform, and does not splinter. Because the bullet is closed on all sides, there is no punching effect in protective materials of bullet traps.

The bullet preferably has no predetermined breaking points. Predetermined breaking points would promote splintering.

The starting material of the bullet is preferably a forgeable copper alloy, CuZn5-CuZn5, CuZn30-CuZn45, referred to as tombac alloys and brass alloys, with or without alloying additions. This material has the necessary ductility and hardness.

In order to enlarge the surface area of the rear, a pyramid-shaped hollow is preferably made at the bottom end of the rear part.

In order for the bullet to behave largely in a dimensionally stable manner, the ductility and hardness of the bullet material of the finished bullet lie within the orders of magnitude of the starting material in a preferred embodiment of the invention.

The bullet preferably has the caliber 9 mm*19 mm and therefore is very well suited for the ammunition of police, the military, and security forces.

A method according to the invention for producing a bullet is characterized in that a bullet blank having a cylindrical rear part and an open hollow cylinder at the nose end is produced from the starting material of the bullet in such a way that the wall thickness of the hollow cylinder continuously decreases from the rear end to the tip, and then the hollow cylinder is shaped into the ogive region by means of an orbital forming process, wherein the blank and the bullet are not subjected to thermal post-processing during the manufacturing. In an orbital forming process, the material hardness of the bullet blank is increased only insignificantly. Only in this way is the trajectory kept optimal. Thermal post-treatment means that the finally shaped bullet is thermally "treated" again, i.e., thermal post-treatment means a thermal treatment of the finally shaped bullet. The advantage of the orbital forming process is precisely that the material properties are defined during the manufacturing of the raw material and are not significantly changed by the processing, the bullet shaping.

The bullet blank is preferably produced by chip-forming processes but can also be produced in cold-forming or hot-forming processes.

The outside diameter DI of the hollow cylinder at the tip is preferably produced in such a way that said outside diameter D 1 is less than the diameter 02 of the hollow cylinder at the rear end. Thus, the hollow cylinder is conical. This simplifies the orbital forming process.

Therefore, the bullet according to the invention consists of a cylindrical rear part and an ogive region, which has a cavity. The wall thickness of the ogive or of the ogive region and the cavity resulting therefrom must be selected in such a way that the bullet is stable enough to ensure reliable feed ing in the weapon and does not deform or splinter in a soft target (gelatin).

A bullet according to the invention preferably has the caliber 9 mm×19 and is identical to the associated operations ammunition, e.g., ammunition according to TR2009, in regard to weapon function and the trajectory of said bullet, and does not penetrate an SKI bulletproof vest (standard according to technical guideline of the German police).

This bullet is principally intended for use by police, the military, and other security forces. However, civilian use is not ruled out.

The bullet blank is principally produced in chip-forming processes but can also be produced in cold-forming or hot-forming processes. The design of the bullet blank already contains the wall thickness progression of the ogive of the finished bullet. The wall thickness is characterized in that the wall thickness decreases toward the tip, which later is the region that experiences the greatest deformation.

The ogive is formed by means of an orbital forming process, which produces the desired shape without increasing the material hardness of the prefabricated blank excessively. The basic material structure is affected much less in the orbital forming process than in traditional forming processes. Therefore, the ductility and hardness remain within the orders of magnitude of the starting material. Because the blank already has a conical or ogival preliminary shape, the necessary forming work is reduced, so that the material hardness of the prefabricated blank is not increased.

The following is a description of what is understood by an orbital forming process. In orbital forming or in an orbital forming process, the workpiece, in this case the bullet blank, is inserted into a die, which fixes it in place from below. This die is clamped onto the fixed part of an orbital forming press. From above, the workpiece is cold-formed by means of one or more rotating dies in succession. The upper die is skewed by a certain angle from the axis of rotation of the upper die. This results in a rolling motion, under which the metal of the workpiece can flow into its new shape. Much greater deformation is possible by orbital forming than by deep-drawing or simple compression. Orbital forming is related to metal spinning. In contrast with metal spinning, however, much more complex shapes are possible. Orbital forming or an orbital forming process (sometimes also called radial riveting) is thus a cold-forming method in which the forming force acts only on a partial surface of the workpiece. By means of an orbital motion of the upper die on a rotationally symmetrical workpiece, large deformation can be realized with relatively low force application.

It is important that the bullet (or the bullet blank) is not subjected to thermal post-treatment during the manufacturing. In addition, the bullet does not have any predetermined breaking points. This means that the bullet blank 5 neither is subjected to a thermal post-treatment nor has predetermined breaking points after the chip-forming process or the cold-forming or hot-forming process. This is important for keeping the ductility and hardness of the finished bullet within the orders of magnitude of the starting material.

The starting material is a forgeable copper alloy, CuZn5-CuZn15, CuZn30-CuZn45, with or without alloying additions, that can be machined and can be cold-formed.

DETAILED DESCRIPTION

Figure 1:
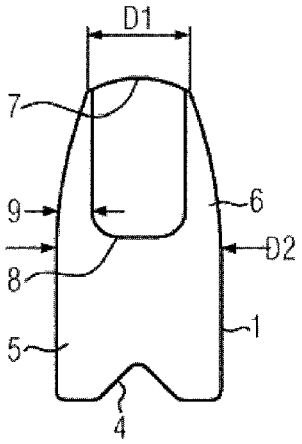
FIG. 1 shows a bullet blank after the turning process and before the treatment by means of an orbital forming process.

FIG. 1 shows a bullet blank 5 after the turning process and before the treatment by means of an orbital forming process, said bullet blank having a cylindrical rear part 1 and a hollow cylinder 6 at the nose end. The hollow cylinder 6 has been hollowed out by turning and is open at the tip 7. The wall thickness 9 of the hollow cylinder 6 continuously decreases from the rear end 8 to the bullet tip 7. The outside diameter D 1 of the hollow cylinder 6 at the bullet tip 7 is less than the diameter D2 of the rear end 8 of the hollow cylinder 6. These two measures make the later orbital forming process easier. A pyramid-shaped hollow 4 has been made at the lower end of the rear part 1.

Figure 2:
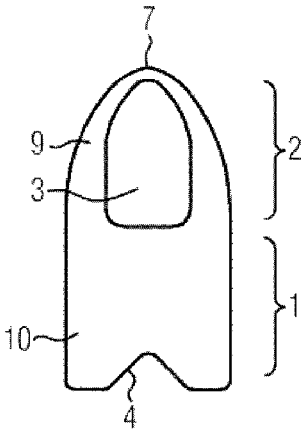
FIG. 2 shows the finished bullet, which has been formed by means of an orbital forming process after the turning as a chip-forming process.

FIG. 2 shows the finished bullet 10, which has been formed by means of an orbital forming process after the turning as a chip-forming process. In the orbital forming process, the ogive region 2 is formed and a cavity 3 is enclosed.

Figure 3:
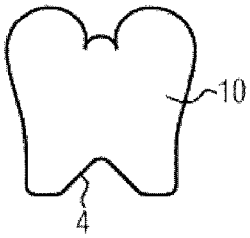
FIG. 3 shows a bullet according to the invention captured in a bulletproof vest after being shot.

FIG. 3 shows a bullet 10 according to the invention captured in a bulletproof vest after being shot. Said bullet is substantially dimensionally stable and not splintered, and the cavity is compressed. A bullet according to the invention does not deform or split when said bullet hits a soft target (gelatin) and therefore is identical to the bullet according to FIG. 2.

The invention claimed is:

1. A bullet for use on a shooting range comprising:
- a solid cylindrical rear part;
- an ogive region at a nose end, the ogive region integral with the cylindrical rear part, the ogive region comprising:
  - a rear end;
  - a bullet tip, comprising a wall of continuously decreasing thickness in the direction of the bullet tip; and
  - a cavity within the ogive region closed on all sides by the wall of decreasing thickness; and
- lacking any predetermined breaking points,
- wherein the cylindrical rear part and the ogive region are formed from at least one starting material selected from the group consisting of a forgeable copper alloy, CuZn5-CuZn15, and CuZn30-CuZn45, and wherein the cylindrical rear part and the ogive region have a same ductility and hardness.

2. The bullet according to claim 1, wherein the starting material further comprises additions.

3. The bullet according to claim 1 further comprising a pyramid shaped hollow at a lower end of the rear part.

4. The bullet according to claim 1, having a caliber of 9 mm*19 mm.

5. A method for producing a bullet comprising:
- forming from a starting material a bullet blank having a cylindrical rear part and an open hollow cylinder at a nose end, the open hollow cylinder comprising a wall having a thickness decreasing from a rear end to a tip; and
- then shaping the hollow cylinder into an ogive region by means of an orbital forming process,
- wherein the bullet blank and the ogive region are not subjected to thermal post-processing, and
- wherein predetermined breaking points are not formed.

6. The method according to claim 5, wherein the bullet blank is produced by at least one of a chip-forming processes, a cold-forming processes, or hot-forming processes.

7. The method according to claim 5, wherein the hollow cylinder of the bullet blanket is formed to have a conical shape.

* * * * *